US006003803A

United States Patent [19]

Knapp et al.

[11] Patent Number: 6,003,803

[45] Date of Patent: Dec. 21, 1999

[54] EXTENSION CORD HOLDER

[75] Inventors: Edward R. Knapp, Evansville, Ind.; Don Ledbetter, Lorenzana PI, Italy

[73] Assignee: Pioneer Plastics, Inc., Dixon, Ky.

[21] Appl. No.: 08/890,499

[22] Filed: Jul. 9, 1997

[51] Int. Cl.[6] ..... B65H 75/40

[52] U.S. Cl. ..... 242/388; 242/405.2; 242/404.3

[58] Field of Search ..... 242/388, 388.1, 242/388.5, 405.2, 405.1, 400.1, 404.3, 603; 191/12 R, 12.2 R; 24/71.1; 294/170, 158, 159

[56] References Cited

U.S. PATENT DOCUMENTS

| | | | |
|---|---|---|---|
| D. 170,162 | 8/1953 | Ogren | D49/1 |
| 578,205 | 3/1897 | Brown et al. . | |
| 1,058,925 | 3/1913 | Toegel . | |
| 1,901,050 | 3/1933 | Voorhees | 242/405.2 |
| 2,048,300 | 7/1936 | Showers | 242/388 |
| 2,470,212 | 5/1949 | Carlson . | |
| 2,490,279 | 12/1949 | Nunamaker | 242/405.1 |
| 2,709,028 | 5/1955 | Cottar | 224/45 |
| 2,778,582 | 1/1957 | Arthur . | |
| 2,853,026 | 9/1958 | Paul | 191/12 R |
| 3,086,723 | 4/1963 | Meeks . | |
| 3,924,819 | 12/1975 | Lapinskas | 242/388 |
| 4,062,430 | 12/1977 | Momberg | 191/12 R |
| 4,123,012 | 10/1978 | Hough . | |
| 4,193,563 | 3/1980 | Vitale | 242/405.2 |
| 4,261,529 | 4/1981 | Sandberg et al. . | |
| 4,497,457 | 2/1985 | Harvey . | |
| 4,586,675 | 5/1986 | Brown . | |
| 4,688,739 | 8/1987 | Moore . | |
| 4,778,125 | 10/1988 | Hu . | |
| 4,779,815 | 10/1988 | Moore et al. . | |
| 4,779,816 | 10/1988 | Varlett . | |
| 4,934,625 | 6/1990 | Richardson . | |
| 4,997,997 | 3/1991 | Moore | 191/12.2 R |
| 5,064,067 | 11/1991 | McAllister et al. | 206/420 |
| 5,181,757 | 1/1993 | Montoya | 294/170 |
| 5,429,321 | 7/1995 | Skyba . | |
| 5,507,544 | 4/1996 | McQuade et al. | 294/170 |
| 5,667,266 | 9/1997 | Giocanti | 294/170 |

*Primary Examiner*—John M. Jillions
*Attorney, Agent, or Firm*—Woodard, Emhardt, Naughton Moriarty & McNett

[57] ABSTRACT

An extension cord holder includes a handle; a main post having top and bottom ends, the main post being connected to the handle at the top end; and, front and rear cord retention arms extending upwardly from the bottom end of the main post to define front and rear upwardly opening slots, each slot sized and shaped for receiving a plurality of loops of an extension cord. An extension cord may be loaded onto the holder by positioning successive loops from a mid point of the cord to the male end of the cord into one slot and from the mid point of the cord to the female end of the cord into the other slot. Deployment of the male and female ends of the cord may be achieved in reverse order.

33 Claims, 2 Drawing Sheets

EXTENSION CORD HOLDER

FIELD OF THE INVENTION

The present invention relates to devices for storing coiled articles, and specifically to a device for receiving and storing an extension cord for deployment of the cord from either of its ends.

BACKGROUND OF THE INVENTION

Many devices have been developed for holding coiled articles such as garden hoses, electrical cords, ropes, clothes lines and the like. Examples of such devices are shown in the following U.S. Patents:

| U.S. Pat. No. | Inventor | Issue Date |
|---|---|---|
| 5,429,321 | Skyba | July 4,1995 |
| 4,997,997 | Moore | March 5, 1991 |
| 4,779,815 | Moore et al. | Oct 24, 1988 |
| 4,688,739 | Moore | August 25, 1987 |
| 4,586,675 | Brown | May 6, 1986 |
| 578,205 | Brown et al. | March 2, 1897 |
| Desl70,162 | Ogren | August 11, 1953 |

Each of the devices disclosed in these patents will allow an extension cord or similar elongate member to be wound up and unwound with varying degrees of ease and convenience; however, such devices do not facilitate deployment of the cord or elongate member from either end. Many such devices are also very cumbersome to carry and manipulate while winding and deploying the cord.

What is needed is a device that facilitates winding and deployment of an electrical cord form either end of the cord and that is easy to carry and manipulate.

SUMMARY OF INVENTION

Generally speaking, an extension cord holder provides easy winding or deployment from either end of the cord. The extension cord holder includes a handle; a main post having top and bottom ends, the main post being connected to the handle at the top end; and, front and rear cord retention arms extending upwardly from the bottom end of the main post to define front and rear upwardly opening slots, each slot sized and shaped for receiving a plurality of loops of an extension cord.

It is an object of the present invention to provide an improved device for receiving and holding an extension cord.

It is another object of the present invention to provide a device for holding and extension for deployment of the cord from either end thereof.

Other objects and advantages of the present invention will become apparent from the following description of the preferred embodiment.

DESCRIPTION OF THE PREFERRED EMBODIMENT

Figure 1:
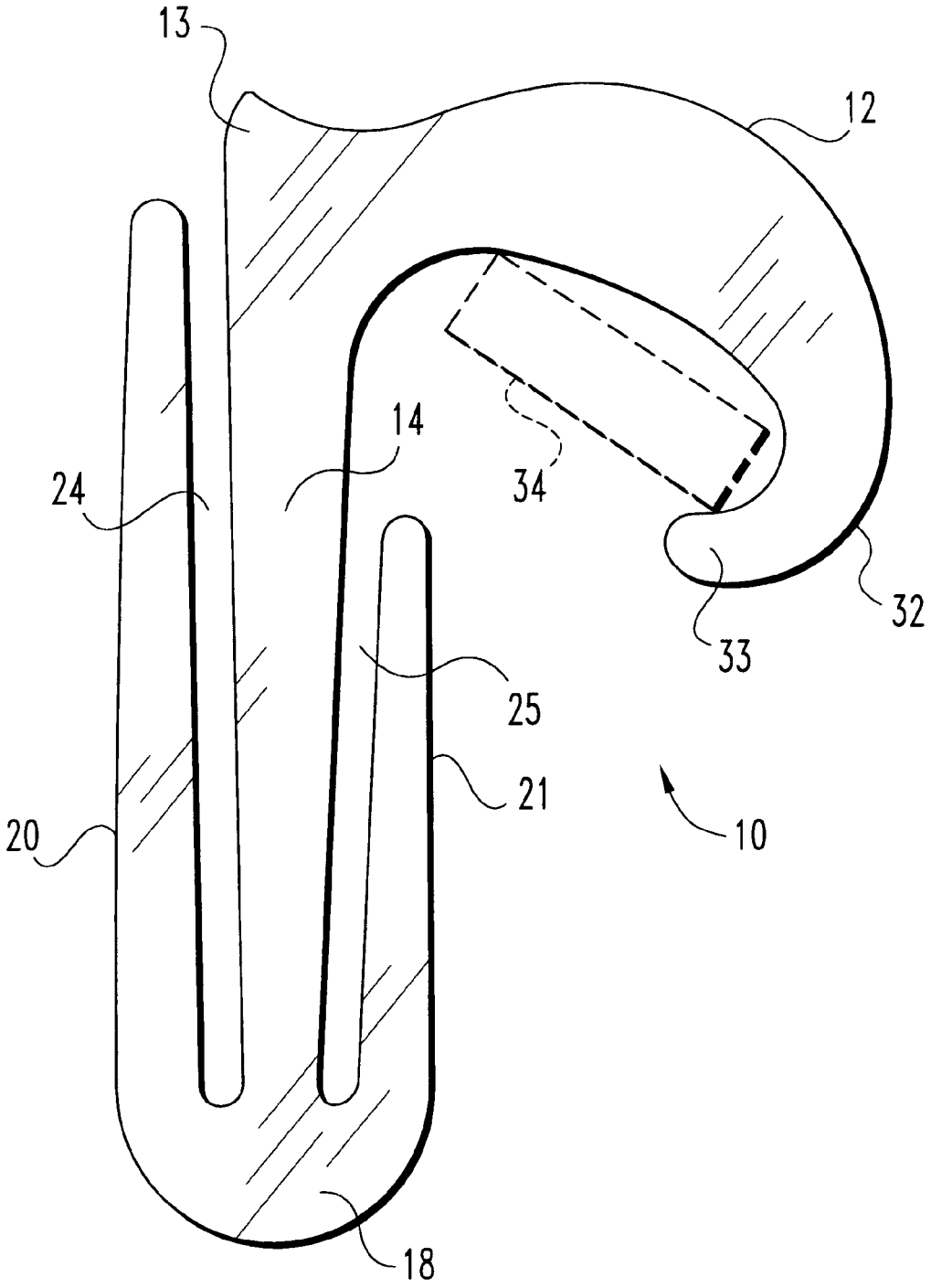
FIG. 1 is a side view of an extension cord holder 10 in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and further modifications in the illustrated device, and further applications of the principles of the invention as illustrated therein are contemplated as would normally occur to one skilled in the art to which the invention relates.

Figure 2:
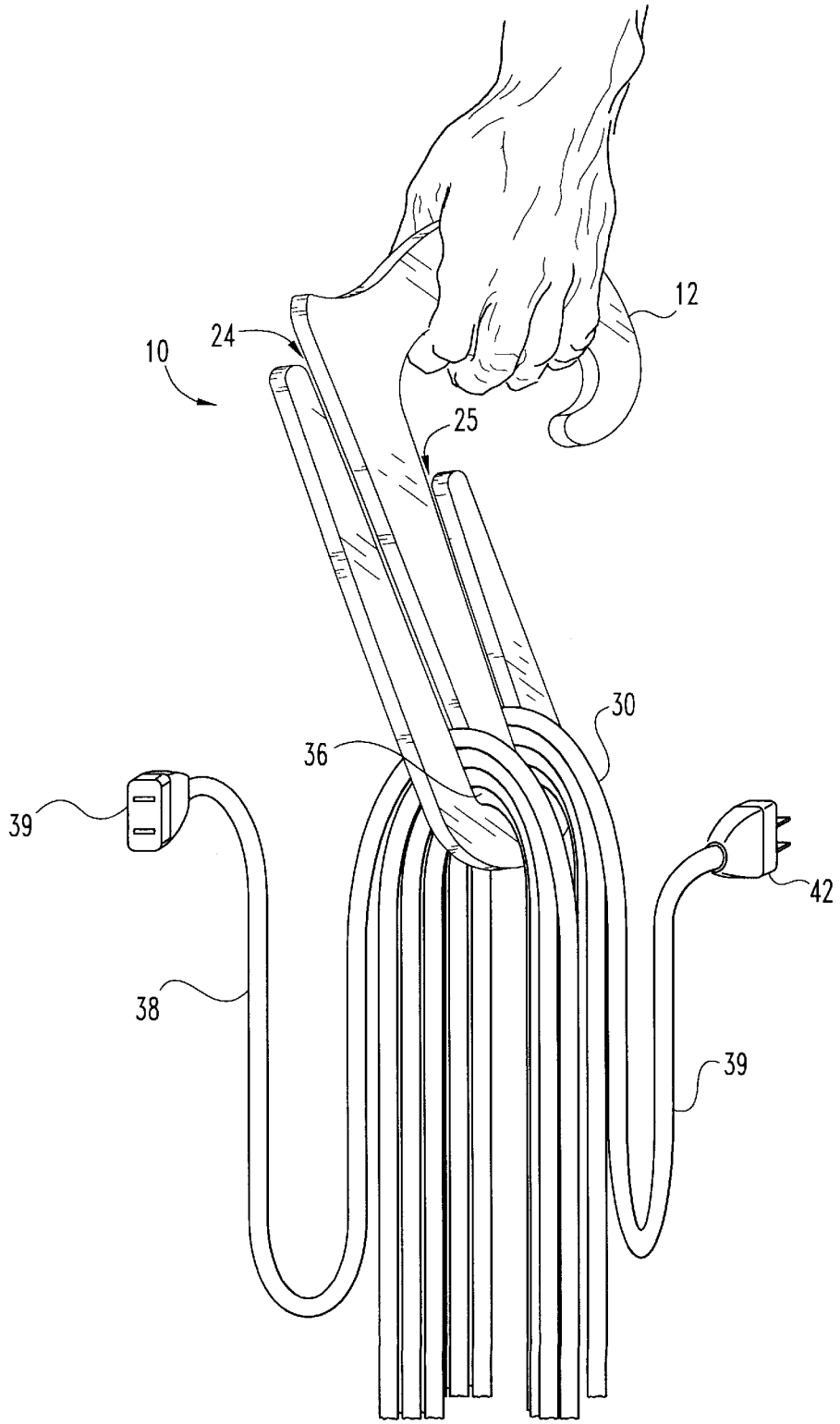
FIG. 2 is a perspective view of the holder 10 of FIG. 1 shown with an extension cord 30 loaded therein.

Referring to FIGS. 1 and 2, there is shown an extension cord holder 10 in accordance with the preferred embodiment of the present invention. Holder 10 is a one piece molded unit, preferably made of a suitable plastic, and defines a generally lateral and arcuate handle 12 that connects at corner 13 with downwardly extending main post 14. At the bottom end 18 of holder 10, main post 14 connects with front and rear, upwardly extending cord retention arms 20 and 21, respectively. In conjunction with main post 14, front and rear arms 20 and 21 form front and rear, upwardly opening and generally straight slots 24 and 25, respectively, therebetween. The width of each slot is preferably constant at approximately 0.375 inches to freely receive a standard 14/3, 0.350 inch diameter extension cord 30 transversely therein, as shown in FIG. 2. Holder 10 may be formed so that slots 24 and 25 are smaller or larger to accommodate cords with different diameters. Holder 10 may also be formed so that either or both of the widths of slots 24 and 25 are not constant, but instead vary along their height or diverge upwardly or downwardly. Such alternative configuration may be desired to better retain a cord within the slot(s), to accommodate cords of slightly varying diameters, or to fit more cord in each slot. In the preferred embodiment, however, slots 24 and 25 both have a constant width as shown so that each loop of cord 30 can only be removed in the reverse order that it was inserted, thereby preventing entanglements. Main post 14 is slightly tapered from upper corner 13 to bottom end 18 so that slots 24 and 25 converge downwardly.

Handle 12 has a pistol grip configuration. That is, it is contoured to better fit within a person's hand when gripped thereby making holder 10 easy to carry and to hold while winding or unwinding cord therefrom. At its rear end 32, handle 12 curves around to define a hook 33. This configuration enables handle 12 to be hooked to a variety of surfaces such as the step 34 of a stepladder, a horizontally extending cord or rod, or a hook.

In use, holder 10 is grasped by the pistol grip handle 12 in one hand. A starting point such as the approximate center 36 (if visible in drawing) of cord 30 is positioned into either of slots 24 or 25. Working from the center 36, all of the female side cord 38 (that portion of cord 30 between starting point 36 and female end 39) is looped in one slot 24. Again, working from the center 36 of cord 30, the male side cord 41 (that portion of cord 30 between starting point 36 and male end 42) is looped from the center 36 to the male end 42 into the other slot 25. To use the cord 30, the user need only remove as much of the male side cord 41 as needed to reach from the outlet (not shown) to a convenient position for holder 10 to be placed, such as a ladder rung 34. Then the user may remove as much of the female side cord 38 as necessary to reach the implement. One embodiment of holder 10 has slots 24 and 25 being about 8 and 5 inches deep, respectively. Used in the above-described manner, and forming loops with about four feet of cord, such embodiment may hold approximately 150 ft. of 14/3 cord.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An extension cord holder, comprising:

a handle being generally horizontally aligned for gripping;

a main post having top and bottom ends, a length and a width, the length of said post being substantially longer than its width said main post being connected to said handle at the top end and extending generally downwardly therefrom along its length; and, front and rear cord retention arms extending upwardly from the bottom end of said main post to define front and rear upwardly opening slots, each slot having a length and a width, the length extending substantially orthogonally relative to the generally horizontally extending handle, and each slot sized and shaped for receiving a plurality of loops of a standard extension cord.

2. The extension cord holder of claim 1 wherein said handle has a pistol grip configuration.

3. The extension cord holder of claim 1 wherein said handle extends generally orthogonally from said main post.

4. The extension cord holder of claim 3 wherein said handle defines a hook at an end thereof opposite said main post.

5. The extension cord holder of claim 4 wherein said handle has a main body and said hook extends below the main body and is sized and shaped to enable hooking said extension cord holder from a ladder rung by said main body and hook.

6. The extension cord holder of claim 1 wherein said slots have a height and a constant width along said height.

7. The extension cord holder of claim 1 wherein said slots converge toward the bottom end of said main post.

8. The extension cord holder of claim 1 wherein said extension cord holder is a one-piece integrally formed member.

9. The extension cord holder of claim 8 wherein said extension cord holder is made of plastic.

10. The extension cord holder of claim 1 wherein said front cord retention arm extends higher than said rear cord retention arm from the bottom end.

11. An extension cord holder, comprising:

a body having a handle, a main post and front and rear cord retention arms which, in conjunction with said main post, define a W-configuration with front and rear upwardly opening slots each for receiving a plurality of loops of an extension cord, said post having a length and a width, the length of said post being substantially longer than its width, one end of said post extending from the handle along the length of the post.

12. The extension cord holder of claim 11 wherein said handle extends generally orthogonally from said main post.

13. The extension cord holder of claim 12 wherein said handle has a main body with front and rear ends and defines a hook at the rear end of the main body.

14. The extension cord holder of claim 13 wherein said hook extends below the main body toward said main post and is sized and shaped to enable hooking said extension cord holder from a ladder rung by said main body and hook.

15. The extension cord holder of claim 11 wherein said handle has a pistol grip configuration.

16. The extension cord holder of claim 11 wherein said slots have a height and a constant width along said height.

17. The extension cord holder of claim 11 wherein said slots converge toward the bottom end of said main post.

18. The extension cord holder of claim 11 wherein said extension cord holder is a one-piece integrally formed member.

19. The extension cord holder of claim 18 wherein said extension cord holder is made of plastic.

20. The extension cord holder of claim 11 wherein said post has a bottom end opposite said handle and said front cord retention arm extends higher than said rear cord retention arm from the bottom end.

21. A method for manipulating an extension cord having male and female ends and a starting point therebetween, comprising the steps of:

providing an extension cord holder having a handle, a main post and front and rear cord retention arms which, in conjunction with said main post, define front and rear upwardly opening slots each for receiving a plurality of loops of an extension cord;

positioning the extension cord so that the starting point of the cord resides within one of the front and rear slots;

working from said starting point, positioning successive loops of the cord from said starting point to said male end into one of the front and rear slots; and, working from said starting point, positioning successive loops of the cord from said starting point to said female end into the other of the front and rear ends.

22. The method for manipulating an extension cord of claim 21 wherein said positioning step includes said starting point being the approximate midpoint of the extension cord.

23. The method for manipulating an extension cord of claim 21 further including removing loops at said male end to enable moving said holder and cord loops a desired distance from an outlet into which said male end is to be plugged.

24. The method for manipulating an extension cord of claim 21 further including removing loops at said female end to enable moving said female end to a desired location away from said holder.

25. The method for manipulating an extension cord of claim 21 wherein said providing step includes said handle having a pistol grip configuration.

26. The method for manipulating an extension cord of claim 21 wherein said providing step includes said handle extending generally orthogonally from said main post.

27. The method for manipulating an extension cord of claim 21 wherein said providing step includes said handle defining a hook at an end thereof opposite said main post.

28. The method for manipulating an extension cord of claim 27 wherein said providing step includes said handle having a main body and said hook extending below the main body and being sized and shaped to enable hooking said extension cord holder from a ladder rung by said handle and hook.

29. The method for manipulating an extension cord of claim 21 wherein said providing step includes said slots having a height and a constant width along said height.

30. The method for manipulating an extension cord of claim 21 wherein said providing step includes said slots converging toward the bottom end of said main post.

31. The method for manipulating an extension cord of claim 21 wherein said providing step includes said extension cord holder being a one-piece integrally formed member.

32. The method for manipulating an extension cord of claim 31 wherein said providing step includes said extension cord holder being made of plastic.

33. The method for manipulating an extension cord of claim 21 wherein said providing step includes said main post having a bottom end opposite said handle and said front cord retention arm extending higher than said rear cord retention arm from the bottom end.

* * * * *